US007007958B2

(12) United States Patent
Wicha

(10) Patent No.: US 7,007,958 B2
(45) Date of Patent: Mar. 7, 2006

(54) WHEEL FOR AUDIO-VISUAL COMPONENT SUPPORT SYSTEM AND AN AUDIO-VISUAL COMPONENT SUPPORT SYSTEM

(75) Inventor: Cristian R. Wicha, Falls Church, VA (US)

(73) Assignee: Becker Designed, Inc., Chantilly, VA (US)

( * ) Notice: Subject to any disclaimer, the term of this patent is extended or adjusted under 35 U.S.C. 154(b) by 56 days.

(21) Appl. No.: 10/410,212

(22) Filed: Apr. 10, 2003

(65) Prior Publication Data

US 2004/0046486 A1 Mar. 11, 2004

Related U.S. Application Data

(63) Continuation-in-part of application No. 29/167,017, filed on Sep. 9, 2002, now Pat. No. Des. 476,173, and a continuation-in-part of application No. 29/167,002, filed on Sep. 9, 2002, now Pat. No. Des. 474,627.

(51) Int. Cl.
*B62B 1/00* (2006.01)

(52) U.S. Cl. ..... 280/47.26; 16/31 R

(58) Field of Classification Search ..... 280/47.35, 280/47.26; 16/29, 31 R, 31 A, 40, 18 CG; 312/249.8, 351.11, 351.13
See application file for complete search history.

(56) References Cited

U.S. PATENT DOCUMENTS

| | | | | |
|---|---|---|---|---|
| 750,612 | A | 1/1904 | Crofut | |
| 1,364,351 | A * | 1/1921 | Chason | 16/40 |
| 2,129,579 | A | 9/1938 | Herold | |
| 2,186,724 | A * | 1/1940 | Harris | 16/40 |
| 2,299,688 | A | 10/1942 | Ferris | |
| 3,069,719 | A * | 12/1962 | Ridge | 16/30 |
| 3,691,590 | A | 9/1972 | Drabert | |
| 3,712,667 | A | 1/1973 | Weber | |
| 3,869,105 | A * | 3/1975 | Daniels | 248/188.8 |
| 3,947,917 | A * | 4/1976 | Schwartzstein et al. | 16/30 |
| 4,024,600 | A * | 5/1977 | Feinberg et al. | 16/31 R |
| 4,245,871 | A | 1/1981 | Rex | |
| 4,332,052 | A * | 6/1982 | Remington | 16/30 |
| 4,455,707 | A * | 6/1984 | Screen | 16/35 R |
| 4,735,469 | A | 4/1988 | Liggett | |
| 5,136,751 | A * | 8/1992 | Coyne et al. | 16/29 |
| D349,448 | S | 8/1994 | Lepp | |
| 5,426,817 | A * | 6/1995 | Rekuc | 16/29 |
| 5,480,169 | A * | 1/1996 | Wang | 280/37 |
| D396,376 | S | 7/1998 | Sze-Man | |
| 5,887,878 | A * | 3/1999 | Tisbo et al. | 280/47.19 |
| 5,924,165 | A | 7/1999 | Gierer et al. | |
| 6,053,587 | A * | 4/2000 | Boerder | 312/249.12 |
| 6,131,926 | A * | 10/2000 | Harlan | 280/47.26 |
| D445,984 | S | 7/2001 | Dickinson et al. | |
| 6,332,546 | B1 | 12/2001 | Hunt | |
| 6,394,471 | B1 * | 5/2002 | Watson | 280/47.19 |
| 6,550,100 | B1 * | 4/2003 | Drucker et al. | 16/31 R |

FOREIGN PATENT DOCUMENTS

EP 486 850 A1 * 10/1991

* cited by examiner

*Primary Examiner*—J. Allen Shriver
*Assistant Examiner*—Christopher Bottorff
(74) *Attorney, Agent, or Firm*—Buchanan Ingersoll PC

(57) ABSTRACT

A support system for supporting audio/video components, including a front support structure which is stationary with respect to the support system, at least one rear support which includes a wheel at the bottom of the rear support arranged to roll in a forward and a backward direction. A wheeled support has a lower surface which curves or angles in an upward direction toward the rear of the support system.

32 Claims, 6 Drawing Sheets

WHEEL FOR AUDIO-VISUAL COMPONENT SUPPORT SYSTEM AND AN AUDIO-VISUAL COMPONENT SUPPORT SYSTEM

CROSS REFERENCE TO RELATED APPLICATIONS

This application is a continuation-in-part of and claims priority from U.S. Design application Ser. No. 29/167,017, filed on Sep. 9, 2002, now U.S. Pat. No. D476,173 and is an continuation-in-part of and claims priority from U.S. Design application Ser. No. 29/167,002, filed on Sep. 9, 2002, now U.S. Pat. No. D474,627, the entire contents of which are incorporated herein in their entirety.

FIELD OF THE INVENTION

The invention relates to a support system for supporting audio/video components, and more particularly to a wheeled support for use in a support system for supporting audio/video components.

BACKGROUND OF THE INVENTION

Various wheels and casters are known for supporting furniture. For example, U.S. Pat. No. 5,924,165 to Gierer et al. discloses a caster foot assembly for use with an appliance such as a wet/dry vacuum cleaner, U.S. Pat. No. D349,448 to Lepp discloses a table leg caster, and U.S. Pat. No. 750,612 to Crofut discloses a wheeled adjusting device for an automatic piano player case. U.S. Pat. No. 2,129,579 to Herold discloses a caster with a protection guard, and U.S. Pat. No. 3,691,590 to Drabert discloses a caster for a chair.

Wheeled furniture items are also known. In U.S. Pat. No. 3,712,667 to Weber, a console and chair combination has a caster system for moving the chair and console combination as a unit. In U.S. Pat. No. 4,245,871 to Rex, a display device for storing a television and a video tape machine has a wheel at each of four corners. U.S. Pat. No. 4,735,469 to Liggett discloses a station for storing audio/video equipment, the station having four legs and a wheeled caster at the bottom of each of the four legs. U.S. Pat. No. 6,332,546 to Hunt discloses a wheeled rack for storing multimedia packages such as compact disks, video cassettes, and computer floppy disks. U.S. Pat. No. D445,984S to Dickinson et al. discloses a laundry cart with a wheel at each of four corners. U.S. Pat. No. D396,376 to Sze-Man discloses a compact disk rack with a wheel at each of four corners. U.S. Pat. No. 2,2992,688 to Ferris discloses a wheeled ironing machine.

In the above-noted patents, the wheels or casters are clearly visible on the legs, thereby detracting from the aesthetic appeal of the furniture or furniture support. Further, the presence of the wheels on four legs of the furniture increases the mobility of furniture during intended movement, but also increases the likelihood of unintended movement from slight forces encountered during daily use.

Accordingly, there is a need for a support system for audio/video components which is aesthetically pleasing and which is not subject to unintended movement.

SUMMARY

The present invention overcomes the above disadvantages of the prior art by providing a support for a storage system for audio/video components intended to rest on a floor which includes generally planar opposed side walls, generally planar opposed front and rear walls joined to each of the opposed side walls. Each of the opposed front and rear walls and the opposed side walls have a lower edge, the lower edges defining an opening. A wheel is arranged partially within the opening, and is arranged for rotation about a single axis, the axis intersecting the opposed side walls. The lower edge of the rear support has a forward edge arranged forward of the wheel and a rearward edge arranged rearward of the wheel, with the rearward edge being higher than the forward edge when the support is in a general vertical position.

The present invention also provides a storage system in which the edges of the walls of the second pair of opposed walls are higher than a lowermost edge of at least one of the first pair of opposed walls when the support is in a general vertical orientation.

The present invention provides a support for a storage system for audio/video components intended to rest on a floor having a first pair of opposed walls, a second pair of opposed walls, each of the opposed walls of the second pair joined to the each of the walls of the first pair of opposed walls. Each of the walls of the first pair and the and second pair has an edge, the edges defining an opening. A wheel is arranged partially within the opening, arranged for rotation about a single axis, the axis intersecting the walls of the first pair of opposed walls. The edge of one wall of the second pair of opposed walls is higher than the edge of another wall of the second pair of opposed walls when the support is in a general vertical orientation.

The invention further provides a support for a storage system for audio/video components intended to rest on a floor, the support having a first wall arranged in a generally vertical orientation, a second wall opposed to the first wall arranged in a generally vertical orientation, the first wall having a bottom edge, the second wall having a bottom edge, the bottom edges of the first and second walls defining an opening. A wheel is arranged partially within the opening, arranged for rotation about a single axis, the single axis intersecting the first and second walls. A forward portion of each of the bottom edges extends forward of the axis, a rearward portion of each of the bottom edges extends rearward of the axis, and the bottom edges of the first wall and the second wall are higher in the rearward portion than in the forward portion when the support is in a generally vertical orientation.

The present invention further provides a support system for supporting audio/video components, the support system has a front and a rear and includes a front support arranged at the front of the support system adapted for resting on a floor surface without rolling, and at least one rear support arranged at the rear of the support system. Each of the at least one rear supports has an edge defining an opening in the rear support and has rotatable wheel arranged at least partially within the opening, arranged to roll in a forward and a backward direction on the floor surface. The lower edge of the rear support having a forward edge arranged forward of the wheel and a rearward edge arranged rearward of the wheel, and the rearward edge is higher than the forward edge when the support system is in an upright position.

A further aspect of the present invention provides a method for moving a support system for storing audio/video components in order to reach connectors on a back surface of the audio/video component that includes lifting a front part support system so the support system rests on wheels arranged at the rear of the support system, each wheel being partially disposed in an opening defined by a lower edge of a rear support, and rolling the support system in a forward direction while the front part is lifted. The lower edge of the rear support has a forward portion forward of an axis of the wheel and a rearward portion rearward of the axis of the wheel, the rearward portion being higher than the forward portion when the support system is in an upright position resting on the front support and the wheels.

In another aspect of the invention, the method provides that the lower edge of the rear support has a forward portion defined forward of an axis of the wheel, a rearward portion defined rearward of the axis of the wheel, and a central portion disposed between the forward portion and the rearward portion, at least one of the forward and rearward portions being higher than the central portions when the support system is in an upright position resting on the front part and the wheels at the rear part of the support system.

A further aspect of the invention provides a wheeled support having a first wall arranged in a generally vertical orientation, a second wall opposed to the first wall arranged in a generally vertical orientation, the first wall having a bottom edge, the second wall having a bottom edge, the bottom edges of the first and second walls defining an opening, a wheel disposed partially within the opening and arranged for rotation about a single axis, the single axis intersecting the first and second walls, a forward portion of each of the bottom edges extending forward of the axis, a rearward portion of each of the bottom edges extending rearward of the axis, and a central portion disposed between the forward portion and the rearward portions adjacent to the wheel axis. The bottom edges of one or both of the first wall and the second wall are higher in the forward and rearward portions than in the central portion when the support is in a generally vertical orientation.

BRIEF DESCRIPTION OF THE DRAWINGS

For further understanding of the nature and objects of the present invention, reference is made to the following detailed description taken in conjunction with the accompanying drawings in which like parts are given like reference numerals, wherein:

FIG. 2.

DETAILED DESCRIPTION OF THE INVENTION

In many homes, owners of audio/video equipment such as televisions, video cassette players, compact disc and DVD players, and stereo equipment find it convenient to group these components together on a rack or storage system, so that they can easily be interconnected and for convenience. Typically, storage racks for the audio/video components are placed against a wall or other partition, with the fronts of the components facing away from the wall and toward the user so that the user can easily access the controls, and also so that the user can view the video or television screen, if present. Audio/video equipment manufacturers typically arrange the connectors for the power and signal cables at the rear side of the components and the user controls at the front of the components. To connect a new component, rearrange the components, or troubleshoot a signal problem, the user often must connect and reconnect the cables located on the rear side of the components. These connectors can be difficult to reach. Further, it can be difficult to correctly seat the signal-carrying cables in the connection without a good view of the connector.

To access the connectors, users often must pull the storage rack away from the wall or turn it sideways so that the user can reach the connectors. Such a pulling motion can easily scratch the floor surface or can snag a rug or carpet. Further, if the storage rack and the audio/video components are heavy, e.g., if a CRT screen is stored on the storage rack, it is easy to overbalance the rack. In order to avoid these problems, the user may sometimes need assistance from another person to help move the storage rack.

Figure 1:
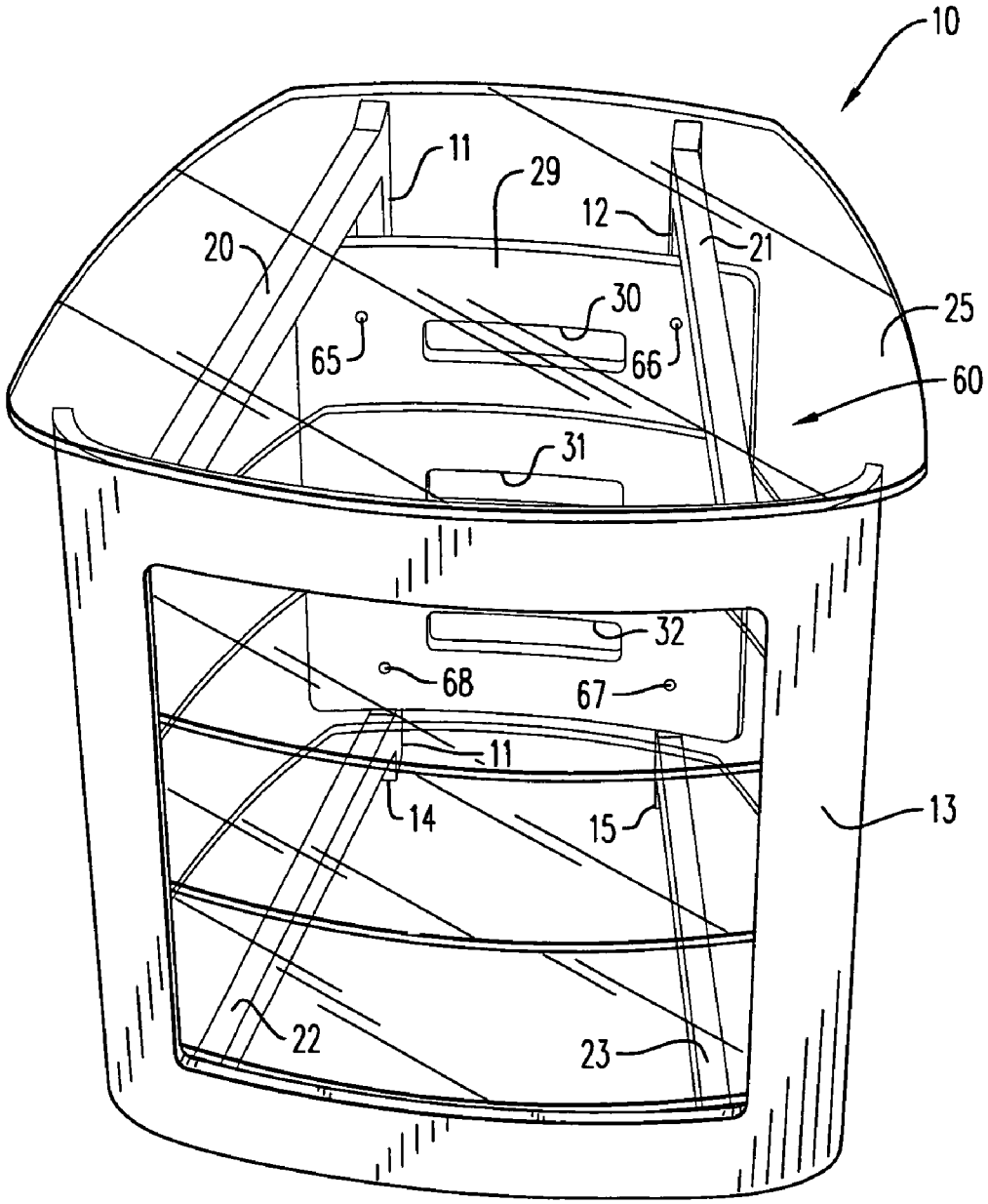
FIG. 1 is a perspective view of an audio/video component support system according to an embodiment of the invention.

FIG. 1 illustrates an audio/video component support system 10, which has a front and a rear, the rear being intended generally to face toward a wall or other partition, and the front being intended generally to face toward the user and away from the wall. The term audio/video component support system includes any type of system which can rest on a floor surface and is suitable for storing audio/video or electronic components, including, but not limited to, storage racks and carts, armoires, consoles, shelf sets, entertainment centers, and wall units.

The support system 10 includes at least one rear support and at least one front support, the rear support being located generally near the rear of the support system and the front support being located generally near the front of the support system. The embodiment illustrated in FIG. 1 illustrates two rear supports 11 and 12, and a front support 13, located at the front of the support system 10 and which is intended to face away from the wall and generally toward the room in which the system 10 is located.

Figure 2:
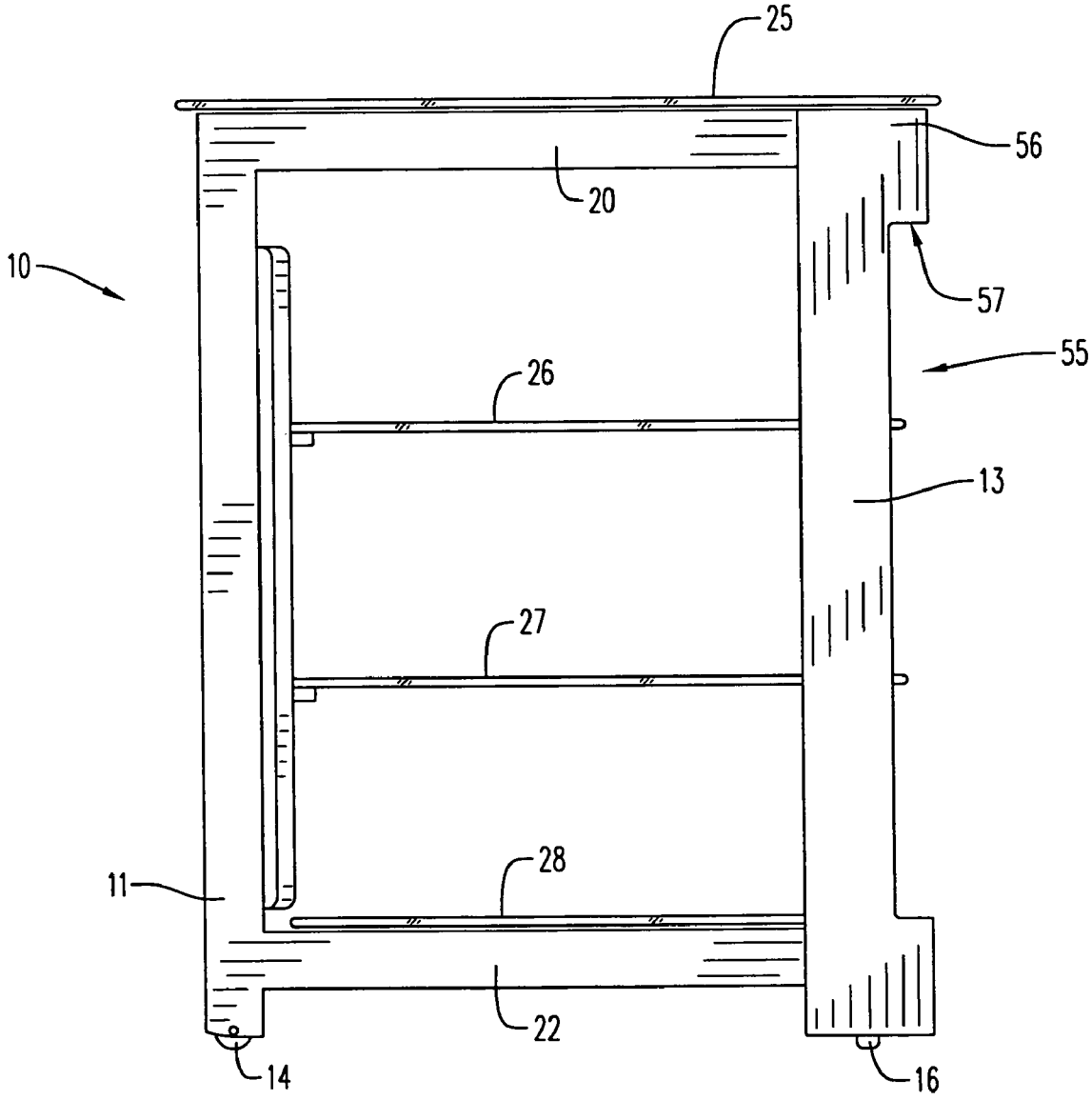
FIG. 2 is a side view of the audio/video component support system of FIG. 1.
Figure 3:
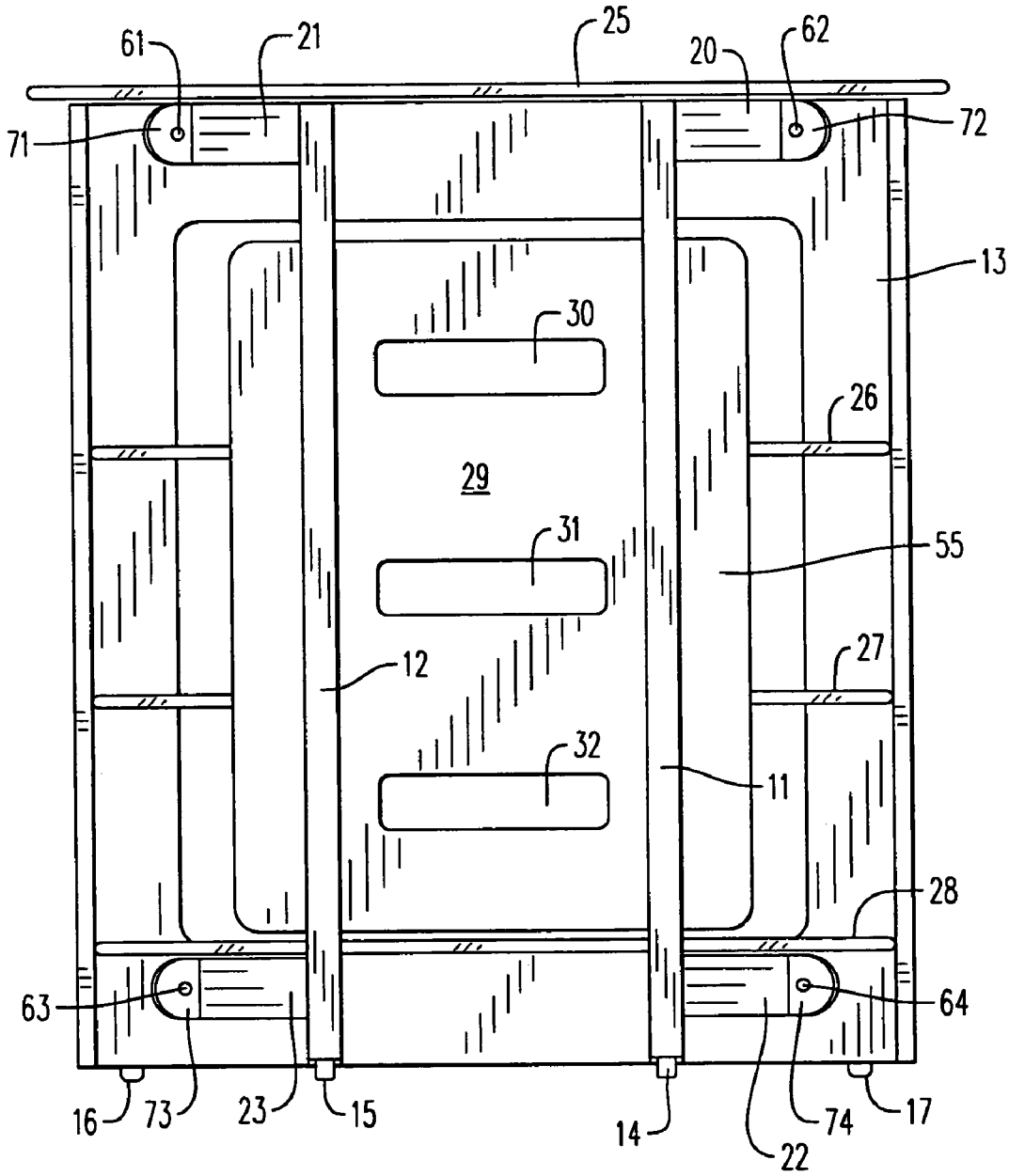
FIG. 3 is a rear view of the audio/video component support system of FIG. 1.

FIG. 2 illustrates a side view of the support system 10 shown in FIG. 1 and FIG. 3 illustrates a rear view thereof. Referring to FIGS. 2 and 3, rear supports 11 and 12 each include a wheel 14 and 15, each of which is arranged at the bottom of the rear support. The front support 13 can rest directly on the floor, or can be supported by two or more legs or bumpers 16 and 17, which are affixed to the front support 13 and which are spaced apart from each other. The front portion 13 of the support system 10 preferably does not include wheels at a bottom surface for rolling the support system 10.

The rear supports 11 and 12 can be part of a frame system 60 which can also includes generally horizontal top members 20 and 21 and lower members 22 and 23, as illustrated in FIG. 1. In the FIG. 1 embodiment, the top members 20 and 21 connect the rear supports 11 and 12 to the front portion 13 and support the top shelf 25. As illustrated in FIG. 2, the lower members extend from the rear supports 11 and 12 to the front support 13. The lower members 22 and 23 are spaced apart from each other and can be spaced further apart at the front support 13 than at the rear supports 11 and 12. Similarly, the top members 20 and 21 are spaced apart from each other and can be spaced further apart at the front support 13 than at the rear supports 11 and 12. As illustrated in FIG. 3, each of the top members 20 and 21 and the lower members 22 and 23 are affixed to the front support 13 so the front support 13 are stationary with respect to the frame 60.

A rear plate 29 can also be arranged at the rear portion of the support system 10 and can include openings 30, 31, and 32 through which wires from the audio/video components can extend. In this way, signal cables can extend from an audio/video component which rests, for example, on shelf 26, through the opening 30, behind the plate 29, back through the opening 31, and into the connectors on an audio/video component located on shelf 27. Power cables can similarly extend from the audio/video components through the openings in the plate 29. The rear plate 29 can hide at least part of the cables from view. The openings in the rear plate 29 can be large enough for a user to readily reach a hand through the openings to connect or disconnect a cable.

The front support 13 can be of any type which is suitable for supporting the front portion of the support system 10. For example, in FIG. 1, the front support 13 has a central opening 55, through which the fronts of the audio/video components are visible. The front support 13 can be curved along its sides to and to at least partially hide the electronic components from view and to provide the support system 10 with a more pleasing appearance. The front support 13 can be formed of any material with sufficient strength to support the weight of the components and the support system itself. In one embodiment, the front support 13 is formed of wood.

In one embodiment, both the front support 13 and the rear plate 29 are wood. In an exemplary embodiment, when the front support 13 is cut to form a central opening 55, the central part which is cut away is used as the rear plate 29.

The system can also include shelves on which the audio/video components can rest. FIGS. 1 and 2 illustrate a top shelf 25, and three lower shelves 26, 27, and 28, although the system can include a lesser or greater number of shelves. Shelves can be of any type suitable for supporting an audio/video component. For example, the shelves can be fixed so that their vertical spacing cannot be adjusted, or can be adjustable so that the shelves can be moved up or down to accommodate different sized components. The shelves can be of a solid material, and for example, can be a substantially transparent material such as glass or polycarbonate.

The wheels 14 and 15 are arranged on the rear supports 11 and 12 so that the support system 10 can easily be moved away from the wall behind the support system and the wires and connectors can easily be reached. To move the support system 10 away from a wall, the user preferably grasps the support system 10 and raises the front of the support system slightly off the floor, so that the weight of the support system 10 and any audio/video components is supported by the wheels 14 and 15 and the user's hands. The user can then roll the system 10 forward away from the wall and lower the front of the support system to the floor. After lowering the support system 10, the user can more easily access the rear portions of the audio/video components stored on the support system 10.

The user can grasp the system 10 at any convenient point to lift the front of the system 10. For example, in the embodiment illustrated in FIG. 1, the user can conveniently place his or her hands in the opening 55 and grasp the lower edge 57 of the upper part 56 of the front support 13.

Figure 4:
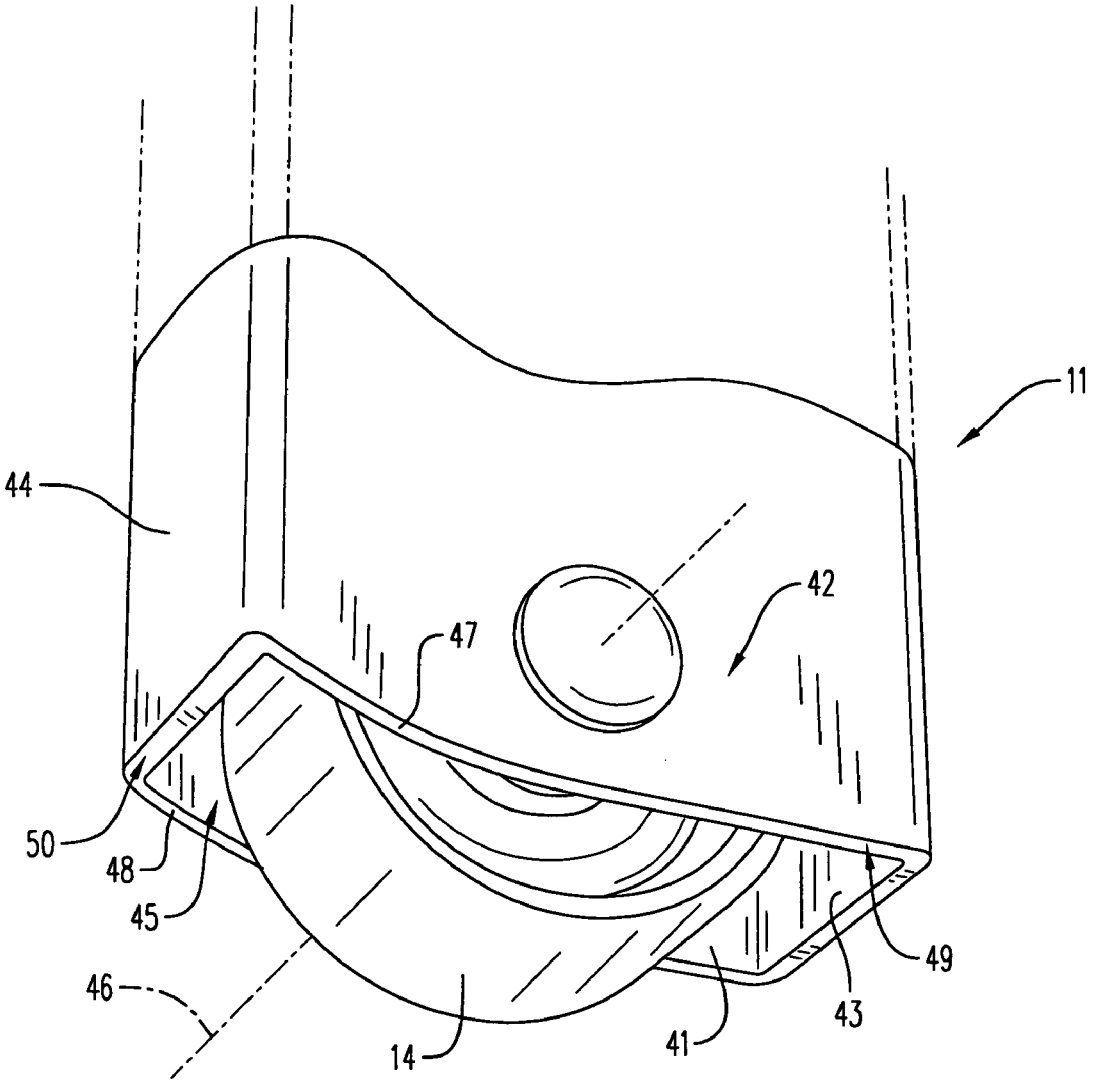
FIG. 4 is a perspective view of a wheeled rear support in accordance with an embodiment of the invention.
Figure 6:
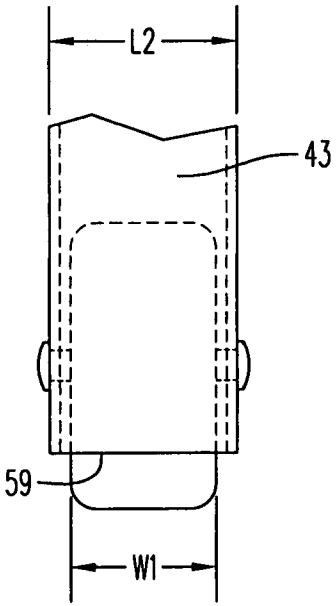
FIG. 6 is a front view of the wheeled rear support of FIG. 4.

FIGS. 4–8 illustrate an embodiment of a rear support 11. As illustrated in FIG. 4, the rear support 11 can be hollow, at least in the lower part of the rear support, so as to form an opening 45 in which the wheel 14 is partially disposed. The rear support 11 extends at least from its lower edge, located below the wheel axis 46 to at least a point above the lower support member 22. The rear support 11 can also be hollow for its entire extent, and can extend as a single piece from its lower edge to the top of the frame 20.

As illustrated in FIGS. 2 and 3, the rear support 11 can be of approximately equal cross sectional dimensions for its entire length, and can be formed as a single piece. In the embodiments illustrated herein, the rear supports 11 and 12 preferably do not swivel or rotate.

In the embodiment illustrated in FIG. 4, the rear support 11 is a structure which has four walls 41, 42, 43, and 44 which define the opening 45 in which the wheel 14 is at least partially located. The rear support 11 could also have a substantially curved shape, or could have fewer or greater than four walls.

In one embodiment, the rear supports 11 and 12, as well as the top members 20 and 21 and the lower members 22 and 23 are steel C-shaped frames. When the front support 13 and the rear plate 29 are formed of wood, the front support 13 and the rear plate can be joined to the steel frames as follows. The front support 13 can be joined to the steel frame with four screws 61, 62, 63, and 64. As illustrated in FIG. 3, the screw 61 extends through a metal plate 71 and into the wood front support 13. The metal plate 71 abuts and is approximately parallel to the front support 13. The metal plate 71 can be affixed to the front end of the top member 21 by a close tolerance fit with the front end of the top member 21, by welding, or by any suitable attachment means. Although the FIG. 3 view illustrates only the outwardly facing portion of the top member 21, the metal plate 71 can extend on both sides of the top member 21. Similarly, screws 62, 63, and 64 can extend through metal plates 72, 73, and 74, respectively, into the front support 12. The rear plate 29 can be attached with four screws 65, 66, 67, and 68 which extend through the rear plate into threaded inserts in the C-frames which form the rear supports 11 and 12, or into threaded holes in the rear supports 11 and 12 themselves.

As illustrated in FIG. 4, the wheel 14 has an axis of rotation 46 which extends through the sides 41 and 42 of the rear support 11. The wheel 14 is arranged to rotate about this axis of rotation 46, so that the wheel 14 can roll in a forward and a backward direction of the support system 10.

Figure 7:
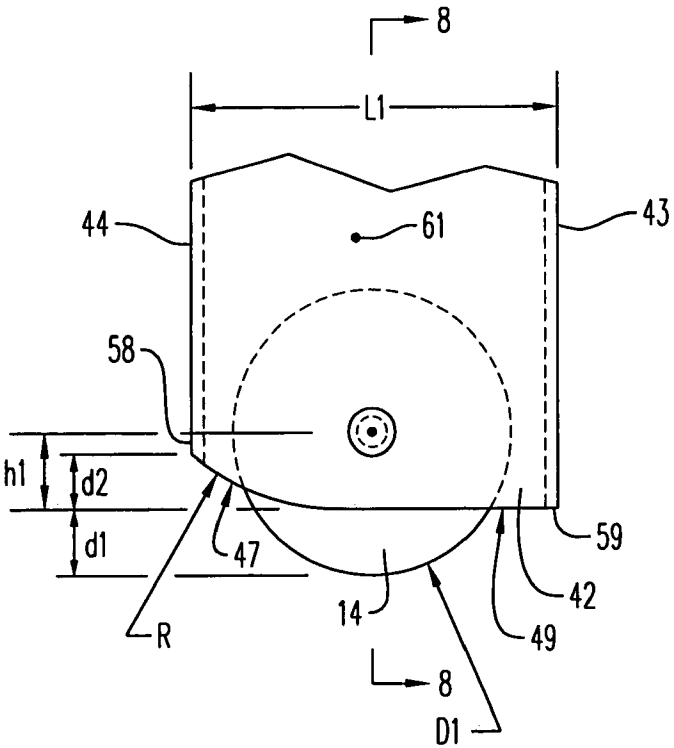
FIG. 7 is a side view of the wheeled rear support of FIG.4
Figure 5:
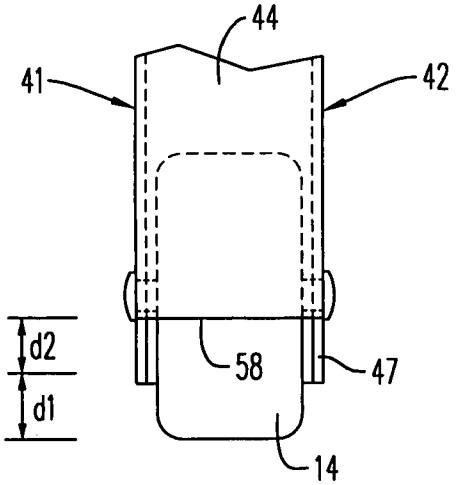
FIG. 5 is a rear view of the wheeled rear support of FIG. 4.

The wheel 14 is arranged partially within the opening 45 so that it extends a distance below the lower surface of the rear support 11. This allows the axis of the wheel 14 to extend into the sides 41 and 42 of the rear support 11. In addition, maintaining the wheel at a distance below the lower surface of the rear support allows the wheel 14 to roll more freely. The distance can be selected to allow the wheel to roll more easily when the system 10 is placed on a carpeted floor. For example, as illustrated in FIG. 7, a preferred embodiment of the wheel extends a distance d1 below the front part of the lower surface of the rear support 11. Preferably, the distance d1 is approximately 1 cm. Because of the clearance between the lower part of the rear support 11 and the floor surface, there is less likelihood that carpet will interfere with the rolling motion of the wheel and less likelihood that the carpet will be snagged by the corners of the rear supports.

The distance between the lower surface of the support 11 and the floor can be set by locating the hole for the wheel axle a particular height h1 above the lower surface of the support 11, if the diameter D1 of the wheel 14 is known. In a preferred embodiment, the wheel 14 has a diameter D1 of approximately 38 cm and a height h1 of approximately 10 cm.

Each of the side walls 41 and 42 have a bottom edge 49 and 48 respectively which is generally flat at the front portion of the rear support 11. See for example, FIGS. 4 and 7 illustrate that the lower surface 49 of the side wall 42 can be generally horizontal in the area between the wheel axis 46 and the front wall 43. By the term horizontal, it is meant that the lower surface is approximately parallel to the floor when the support system 10 is in an upright position supported on the front support 13 and the rear supports 11 and 12.

In the rear portion of the rear support 11, the opposed side walls 41 and 42 of the rear support 11 are inclined in an upward direction by way of a curved surface. See, for example, FIG. 7, which illustrates that the lower surface 47 curves in an upward direction toward the rear wall 44 in an area of the rear support 11 which is between the wheel axis 46 and the rear wall 44 of the leg support 11.

As a result, the lower edge 58 of the rear wall 44 of the rear support 11 is located above the lower edge 59 of the front wall 43 of the rear support 11. In a preferred embodiment, the distance d2 that the lower edge 58 of the rear wall 44 is above the lower edge 59 of the front wall 43 and the flat portions of the side walls 42 and 41 is approximately 7 mm. This distance d2 can be greater, or lesser as desired.

A preferred embodiment of the wheel 14 illustrated in FIG. 7, can have a diameter D1 of approximately 38 mm with a clearance of approximately 4 millimeters between the wheel and the inner surfaces of the rear support 11 at the front and rear, and a clearance of approximately 2 millimeters between the sides of the wheel 14 and the inner surfaces of the sides 41 and 42 of the rear support. Also, the length of the sides L1 is preferably approximately 50 cm, and the length L2 of the front walls 43, 44 is preferably approximately 25 cm. Therefore, to allow proper clearance, the wheel 14 Preferably has a width W1 of approximately 19 cm. These dimensions can also be larger or smaller.

The radius R of the upwardly curving portion of the sides 41 and 42 preferably can be approximately the same as, or greater or lesser than the diameter of the wheel. In the preferred embodiment illustrated in FIG. 7, the radius of curvature R preferably is approximately 35 mm, or slightly less than the radius of the wheel 14. In addition, the point at which the lower surface of the rear support 11 begins to curve in an upward direction can also be varied from somewhat forward of the wheel axis 46 to somewhat rearward of the wheel axis 46. As illustrated in FIG. 7, the center of curvature 61 preferably can be higher than the wheel axis 46 when the rear support 11 is in a generally vertical orientation.

Further, it is not necessary that lower edges of the sides 41 and 42 to the rear of the axis 46 of the wheel be curved. It is also possible that the lower edges can be inclined at an angle toward the rear of the support 11.

For the embodiment illustrated in FIG. 1, it is generally sufficient to lift the front portion 13 of the support system 10 only a small distance above the floor, e.g. one or two inches, so that the support system 10 can be rolled forward. Therefore, the rear supports 11 and 12 should be curved enough to allow the front of the support system 10 to be raised a few inches above the floor without causing the lower edge 58 to interfere with the floor or the carpet. Preferably, in the embodiment of FIG. 7, the distance d2 between the lower edge 58 of the rear wall 44 and the lower edge 59 of the front wall 43 is approximately 7 mm, or slightly less than the distance that the distance the wheel 14 extends below the lower surface 49.

The rear support 11 can be formed of any suitable material or materials having sufficient strength and thickness to support the weight of the support system 10 and the audio/video components. In one embodiment, the rear support is formed of a metal having a thickness of approximately 2–5 mm.

In embodiments of the invention in which a more traditional furniture-like appearance is desired, these distances can be relatively small, so that the wheels will be less noticeable. The distances d1 and d2 should be sufficient so that the rear supports do not drag against the floor or the carpet when the support system 10 is tilted rearward and moved. In other embodiments, the lower edge 47 may be curved or angled even further upward. The point on the side walls 41 and 42 at which the curvature or angle begins and the amount of upward curve can also depend on the distance between the front and rear supports, the diameter of the wheels 14, and the type of floor surface. For example, it can be desirable to have the lower edge curve further upward for smaller sized support systems 10, e.g., the amount of upward curve can be greater for support systems in which the distance between the front support 13 and the rear supports 11 and 12 is relatively small. The amount of upward curve can also be varied in order to make the wheels 14 and 15 more or less noticeable.

Figure 8:
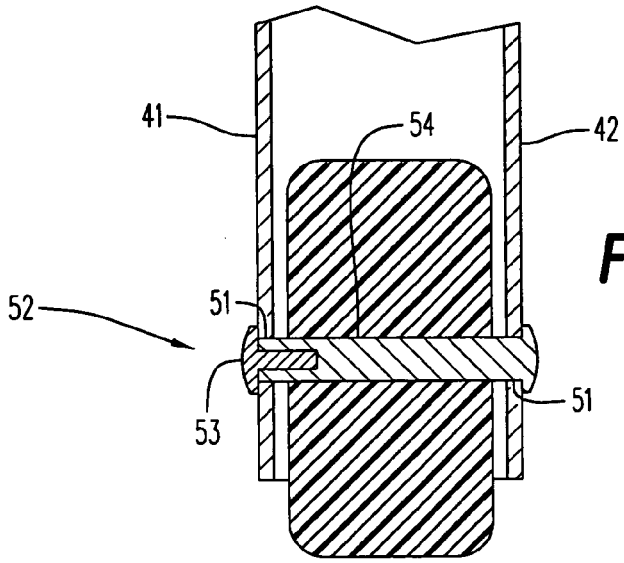
FIG. 8 is a cross sectional view of the wheeled rear support taken along line 8—8 of FIG. 7.

As illustrated in FIG. 8, each of the sides 42 and 41 has a hole 51 through which an axle 52 of the wheel 14 can extend. The axle 52 can be of any suitable type. For example, the axle 52 can be a two part axle with the first part 53 extending through the side wall 41 and with a second part 54 extending through the side wall 42. The second part 54 can join the first part 53 with a screw thread or other interface type. It will be appreciated that other types of axles could also be used, including, but not limited to a bolt, nut, and washer combination. It will also be appreciated that bushings or other devices intended to reduce friction can also be used. Further, it is not necessary that the axle extend the entire way through the sides 41 and 42. The axle 52 could alternatively be supported at the interior surfaces of the sides 41 and 42.

The wheel 14 can be arranged to roll in a single direction, e.g., forward and backward. The wheel 14 can have a single axis of rotation 46, and the rear support 11 can be stationary with respect to the frame 60 and the support system 10, allowing the wheel to move in only one direction, e.g. forward and backward.

Figure 9:
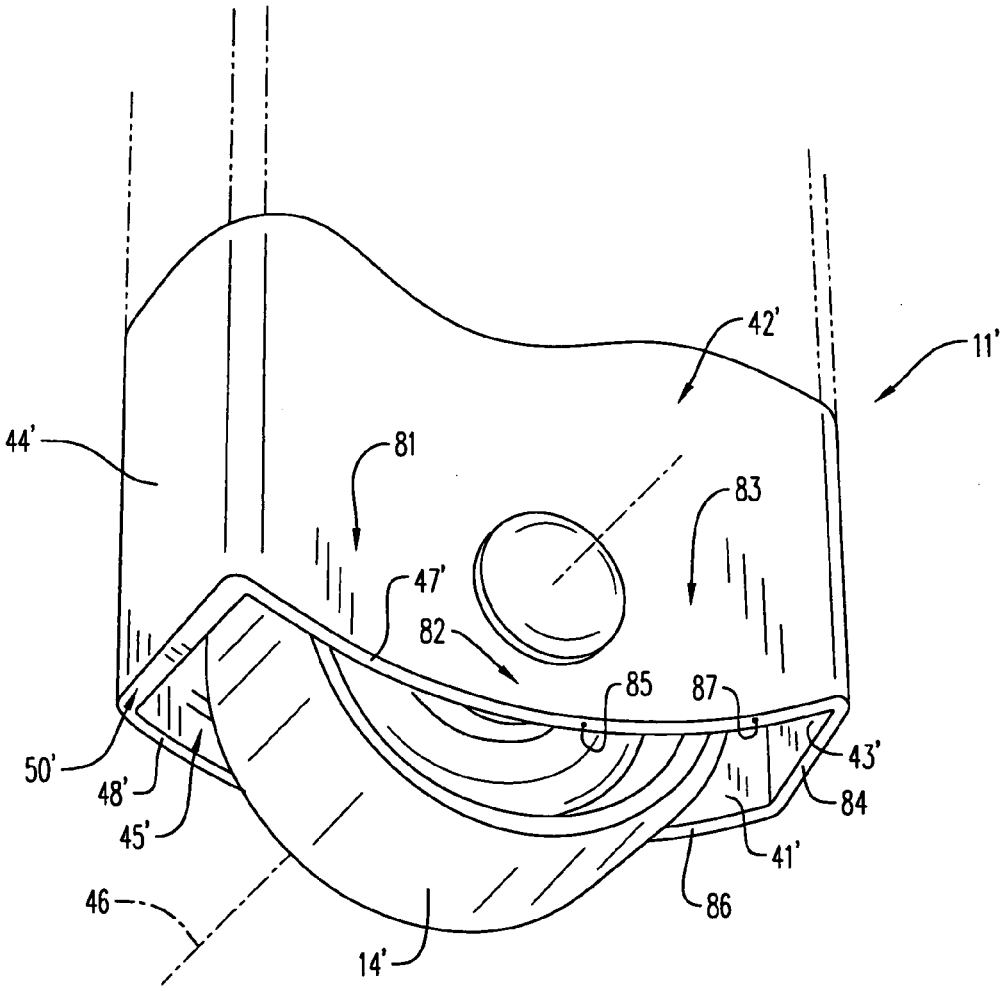
FIG. 9 is a perspective view of another embodiment of a support for a storage system for audio/video components.

FIG. 9 illustrates another embodiment of a rear support element 11' suitable for use in a support system such as those described herein. As illustrated in FIG. 9, the opposed sides 41', 42', 43', and 44' define an opening 45' in which wheel 14' is disposed, so that the wheel 14' extends a distance below the lower surface of the rear support element 11'.

In the embodiment illustrated in FIG. 9, the opposed front and rear walls 43' and 44' have bottom edges 50' and 84 which are higher than the bottom edge 85 of the opposed walls 41' and 42' in the central portion 82, e.g., in the vicinity of the wheel axis 46.

In an exemplary embodiment, the opposed walls 41' and 42' curve in an upward direction in one or both of the rearward portion 81 and forward portion 83. In another embodiment, one or both of the bottom edges of the opposed walls 41' and 42' may be inclined at an angle upward in the forward and rearward portions. By the term rearward portion, it meant the portion of a wall between the wheel axis 46 and a rear wall, e.g., wall 44'. By the term forward portion, it is meant the portion of a wall between the wheel axis 46 and a forward wall, e.g., 43'. In these embodiments, the bottom edges 47', 48', 86, and 87 in the forwardmost and rearwardmost parts of the opposed walls are higher than the bottom walls 85 in the central part 82. It is not necessary that the bottom edge should have a smooth curve or incline, as it is also envisioned that the opposed walls 41' and 42' could have any suitable shape, including irregular shapes.

Suitable dimensions, material, and use for the rear support element 11' are as described in previous paragraphs discussing embodiments of the support 11.

Although only the rear support element 11 has been described in the preceding paragraphs, it will be appreciated that a second rear support element 12 can be essentially the same as rear support element 11, spaced apart from the rear support 11 and arranged near the rear of the support system 10. Further, it is also envisioned that the support system can have as few as one, or more than two, rear supports. It is also envisioned that the support system could include similar supports arranged to allow the system to be easily rolled away from a wall at a different face of the support system, for example, at a side of the support system.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A support system for audio/video components intended to rest on a floor, the support system comprising:

at least one rear support, at least one front support, and means for supporting a horizontal shelf extending therebetween;

said at least one rear support including:

a first pair of opposed walls, a second pair of opposed wails, each of the opposed walls of the second pair joined to each of the walls of the first pair of opposed walls to define a hollow support structure having an end opening, and a wheel disposed partially within the opening, said wheel being arranged for rotation about a single axis, the axis intersecting the walls of one of the first and second pairs of opposed walls, wherein at least one wall of at least one of the first and second pairs of opposed walls having an edge that is higher than an edge of the other wall of said at least one of the first and second pairs of opposed walls when the support is in a general vertical orientation.

2. A support as in claim 1, wherein each of the walls of the first and second pairs of opposed walls are generally planar, and wherein the first pair of opposed walls and the second pair of opposed walls define a rectangular opening.

3. A support according to claim 1, wherein the edges of one of the first and second pairs of opposed walls are inclined an upward direction toward the at least one wall of said at least one of the first and second pairs having a higher edge.

4. A support according to claim 3, wherein the inclined edges are curved upward in a direction toward the one wall of the second pair of opposed wails having a higher edge.

5. A support according to claim 4, wherein the curved edges have a center of curvature located above the wheel axis when the support is in a generally vertical orientation.

6. A support according to claim 1, wherein each of the edges of the first pair of opposed walls is curved in an upward direction in a portion adjacent to the one wall of the second pair of opposed walls having a higher edge, and wherein each of the edges of the first pair of opposed walls is generally horizontal in an area adjacent to said another wall of the second pair of opposed walls.

7. A support as in claim 1, wherein the wheel has a single axis of rotation, the axis of rotation being stationary with respect to the support.

8. A support system as in claim 1, wherein the wheel has an axle extending through the first pair of opposed walls and wherein said edge that is higher than the edge of the other wall is disposed lower than the wheel axle when the support is in a general vertical orientation.

9. A support as in claim 1, wherein the first pair of opposed walls are side walls, and the second pair of opposed walls are front and rear walls.

10. A support system for audio/video components intended to rest on a floor, the support system comprising:

at least one rear support, at feast one front support, and means for supporting a horizontal shelf extending therebetween;

said at least one rear support including:

a first wall arranged in a generally vertical orientation, a second wall opposed to the first wall arranged in a generally vertical orientation, the first wall having a bottom edge, the second wall having a bottom edge, the bottom edges of the first and second walls defining a hollow support structure having an end opening, a wheel disposed partially within the opening and arranged for rotation about a single axis, the single axis intersecting the first and second walls, a forward portion of each of the bottom edges extending forward of the axis, a rearward portion of each of the bottom edges extending rearward of the axis, the bottom edges of the first wall and the second wall being higher in one of the forward and rearward portions than in the other of the forward and rearward portions when the support is in a generally vertical orientation.

11. The support as in claim 10, wherein the bottom edges of the first wall and the second wall are inclined an upward direction in at least the rearward portions.

12. The support as in claim 11, wherein the bottom edges of the first wall and the second wall curve in an upward direction in at least the rearward portions in a direction away from the axis.

13. The support as in claim 10, wherein the bottom edges of the first wall and the second wall curve in an upward direction in at least the rearward portions and the bottom edges of the first wall and the second wall are generally horizontal in at least part of the forward portion when the support is in a generally vertical orientation.

14. The support as in claim 10, wherein the wheel has an axle coincident with the single axis of rotation, the axle extending through each of the first wall and the second wall and wherein said bottom edges that are higher in one of the forward and rearward portions are disposed lower than the wheel axle when the support is in a general vertical orientation.

15. The support as in claim 10, wherein the single axis of rotation is stationary with respect to the first wall and the second wall.

16. The support as in claim 10, further comprising: at least one member connecting the first wall and the second wall.

17. A support as in claim 10, wherein the first wall and the second wall are each generally planar in form, and approximately parallel to each other.

18. A support according to claim 10, wherein the curved edge has a center of curvature located above the wheel axis when the support is in a generally vertical orientation.

19. A support system for supporting audio/video components, the system having a front and a rear and comprising:

a first support arranged at the front of the support system adapted for resting on a floor surface without rolling, at least one second support arranged at the rear of the support system, the at least one second support defining a tubular hollow structure having an edge defining an opening, means for supporting at least one horizontal shelf extending between the first and second support;

said at least one second support having a rotatable wheel arranged at least partially within the opening, the wheel having an axis of rotation and being arranged to roll on a floor surface, the edge having a first portion arranged forward of the wheel axis and a second portion arranged rearward of the wheel axis, one of the first and second portions being higher than the other of the first and second portions when the support system is in an upright orientation; and wherein the hollow structure of said at least one second support has a predetermined height extending at least to said horizontal shelf support means.

20. A support system as in claim 19, wherein the opening is defined by opposed side walls, the opposed side walls each having a lower edge, wherein each of the lower edges of the side walls has an upward curve in a rearward direction.

21. A support system as in claim 19, wherein each of the edges of the opposed side walls is generally horizontal in a portion forward of the axis and is curved in an upward direction in a portion rearward of the axis.

22. A support system as in claim 19, wherein the opening is defined by opposed side walls and opposed front and rear walls, the side walls each having a lower edge, wherein the rear wall is higher than the front wall when the support system is in an upright orientation.

23. A support system as in claim 22, wherein the opposed side walls have an edge which is inclined in an upward direction toward the rear wall.

24. A support system as in claim 22, wherein the opposed side walls have an edge which is curved in an upward direction toward the rear wall.

25. A support system as in claim 19, wherein the rotatable wheel has a single axis of rotation which is stationary with respect to the at least one second support.

26. A support system as in claim 25, wherein the wheel has an axle extending through the opposed side walls.

27. A support system as in claim 19, wherein the support system includes a frame comprising the at least one second support, the first front support, and at least one generally horizontal framing member affixed to both the first support and the second support.

28. A support system as in claim 19, wherein the support system comprises two second supports, one first support, and a frame formed of the two second supports, the one first support, and at least one generally horizontal framing member affixed to both the first support and at least one of the second supports.

29. The support system of claim 19, wherein the hollow structure of said at least one second support extends substantially its entire extent.

30. A support system for supporting audio/video components, the system having a front and a rear and comprising:

a first support arranged at the front of the support system adapted for resting on a floor surface without rolling, at least one second support arranged at the rear of the support system, the at least one second support defining a tubular hollow structure having an edge defining an opening, means for supporting at least one horizontal shelf extending between the first and second supports;

said at least one second support having a rotatable wheel arranged at least partially within the opening, the wheel having an axis of rotation and being arranged to roll on a floor surface, the edge having a first portion arranged forward of the wheel axis, a second portion arranged rearward of the wheel axis, and a central portion arranged between the first portion and the second portion, wherein at least one of the first and second portions is higher than the central portion when the support system is in an upright orientation;

wherein the hollow structure of said at least one second support has a predetermined height extending at least to said horizontal shelf support means.

31. The support system as in claim 30, wherein both the first portion and the second portion are higher than the central portion when the support system in an upright orientation.

32. The support system of claim 30, wherein the hollow structure of said at least one second support extends substantially its entire extent.

* * * * *